US007096688B2

(12) United States Patent
Paradowski

(10) Patent No.: US 7,096,688 B2
(45) Date of Patent: Aug. 29, 2006

(54) LIQUEFACTION METHOD COMPRISING AT LEAST A COOLANT MIXTURE USING BOTH ETHANE AND ETHYLENE

(75) Inventor: Henri Paradowski, Cergy (FR)

(73) Assignee: Technip France, (FR)

( * ) Notice: Subject to any disclaimer, the term of this patent is extended or adjusted under 35 U.S.C. 154(b) by 252 days.

(21) Appl. No.: 10/486,444

(22) PCT Filed: Aug. 28, 2002

(86) PCT No.: PCT/FR02/02951

§ 371 (c)(1),
(2), (4) Date: Mar. 15, 2004

(87) PCT Pub. No.: WO03/023303

PCT Pub. Date: Mar. 20, 2003

(65) Prior Publication Data

US 2004/0255617 A1 Dec. 23, 2004

(30) Foreign Application Priority Data

Sep. 13, 2001 (FR) ..... 01 11869

(51) Int. Cl.
*F25J 1/00* (2006.01)

(52) U.S. Cl. ..... 62/612; 62/611

(58) Field of Classification Search ..... 62/611, 62/612

See application file for complete search history.

(56) References Cited

U.S. PATENT DOCUMENTS

| | | | | |
|---|---|---|---|---|
| 4,112,700 | A * | 9/1978 | Forg | 62/612 |
| 5,497,626 | A * | 3/1996 | Howard et al. | 62/612 |
| 6,250,105 | B1 | 6/2001 | Kimble | |
| 6,269,655 | B1 | 8/2001 | Roberts et al. | |

FOREIGN PATENT DOCUMENTS

| | | |
|---|---|---|
| DE | 3 52 10 60 | 12/1985 |
| GB | 1 288 762 | 9/1972 |

OTHER PUBLICATIONS

International Search Report

* cited by examiner

*Primary Examiner*—Cheryl Tyler
*Assistant Examiner*—Michael J. Early
(74) *Attorney, Agent, or Firm*—Ostrolenk, Faber, Gerb & Soffen, LLP

(57) ABSTRACT

The invention concerns a method comprising: (a) a first step whereby natural gas (1) is subjected to a first refrigerating cycle to obtain cooled natural gas (4), and brought to a temperature less than 20° C. by a first coolant (201); a second step whereby the cooled natural gas (4) is subjected to a second refrigerating cycle wherein the cooled natural gas (4) is cooled and condensed by a second coolant (103) comprising methane, ethane, propane, and nitrogen. The second coolant (103) further contains ethylene, the total ethane and ethylene content being close to 50 mole %.

17 Claims, 2 Drawing Sheets

201
200
E203
1
100
V203
220
221
E1
216
219
D1
2
101
203
204
215
V202
205
E202
E2
218
212
213
217
222
224
V204
214
206
D2
E201
3
102
207
223
208
211
GT
E3
V201
K201.1
K201.2
K201.3
K201
D3
210
4
103
209

107
K101
K101.1
K101.2
E4
GT
106
109
104
D4
5
108
105
E101
110
E102
GE
V10
111
T101

LIQUEFACTION METHOD COMPRISING AT LEAST A COOLANT MIXTURE USING BOTH ETHANE AND ETHYLENE

The present invention relates, in a general manner and according to a first of its aspects, to the gas industry and in particular to a process for liquefying natural gas.

More precisely, the invention relates to a process for liquefying a natural gas, under pressure, containing methane and $C_2$ and higher hydrocarbons, said process comprising:

(a) a first step I, in which the natural gas is subjected to a first refrigerating cycle in order to obtain a cooled natural gas and is taken to a temperature below −20° C. by a first coolant, said first refrigerating cycle comprising a succession of substeps (i) to (v) in which the first coolant is subcooled, (ii) expanded, (iii) vaporized, (iv) compressed and (v) at least partly condensed by cooling with a first external refrigerating fluid;

(b) a second step II, in which the cooled natural gas is subjected to a second refrigerating cycle in which the cooled natural gas is cooled and condensed by a second coolant comprising methane, ethane, propane and nitrogen, said second refrigerating cycle comprising a succession of substeps (i) to (vi) in which the second coolant is (i) subcooled, (ii) expanded, (iii) vaporized, (iv) compressed, (v) cooled with a second external refrigerating fluid and (vi) at least partly condensed by cooling with said first coolant.

Such a process is known from the prior art. Thus, U.S. Pat. No. 6,105,389 discloses a process according to the preamble described above.

Such a process has drawbacks, especially when the intake pressure of the natural gas in the plant drops. This is because, in such a case, the liquefaction temperature of the natural gas may be significantly lowered. Thus, during conventional use of a plant according to the process of the prior art, the intake pressure of the natural gas is close to 45 bar. For various reasons, for example for maintenance, the natural gas intake pressure may drop to a pressure of about 30 bar. In this case, the profile of the natural gas condensation curve is modified and results in a relatively colder condensation temperature. In practice, relative variations in the level of condensation of the natural gas will be observed in various parts of the cryogenic exchanger or exchangers compared with the situation in which the natural gas is at a pressure of 45 bar. As a corollary, the pressure needed to liquefy the natural gas increases. Likewise, the pressure of the refrigerating fluids may increase significantly on the output side of the compressor, consequently increasing the design pressure of the compressor and of the equipment located downstream.

Under these conditions, the invention aims to alleviate the drawbacks associated with a reduction in the natural gas intake pressure in the plant by (i) limiting the increase in the necessary compression power, (ii) improving the heat exchange within the cryogenic exchangers without modifying their structure or their area and (iii) keeping an substantially constant compression pressure on the output side of the compressor.

For this purpose, the process of the invention, which is moreover in accordance with the generic definition given in the above preamble, is essentially characterized in that the second coolant furthermore contains ethylene.

According to a first variant of the liquefaction process of the invention, the second coolant is separated into a relatively more volatile first fraction and a relatively less volatile second fraction, said second fraction then being treated in accordance with substeps (i) and (ii) of step II, in order to obtain a cooled and expanded second fraction, and then is treated in accordance with substep (iii) of step II, said first fraction being cooled, subcooled, expanded, vaporized and then mixed with the cooled and expanded second fraction.

Preferably, the natural gas liquefaction process according to the invention uses a natural gas at a pressure of below 40 bar.

Preferably, the natural gas liquefaction process according to the first variant of the invention uses a natural gas at a pressure of below 45 bar.

At least one of the first and second external refrigerating fluids may be a fluid available at ambient temperature.

At least a first expansion turbine, preferably coupled to a generator, may be used for the treatment of the cooled second coolant at substep (ii) of step II.

Advantageously, the first coolant may consist of a container mainly of ethane and propane.

Preferably, the first coolant may consist mainly of a hydrocarbon containing three carbon atoms, propane or propylene.

The invention will be better understood and other objects, features, details and advantages thereof will become more clearly apparent over the course of the description that follows, with reference to the appended schematic drawings given solely by way of non-limiting example and in which.

In both these figures, it should in particular be noted that the symbols "GT" stands for "gas turbine" and "EG" stands for "electric generator".

Figure 1:
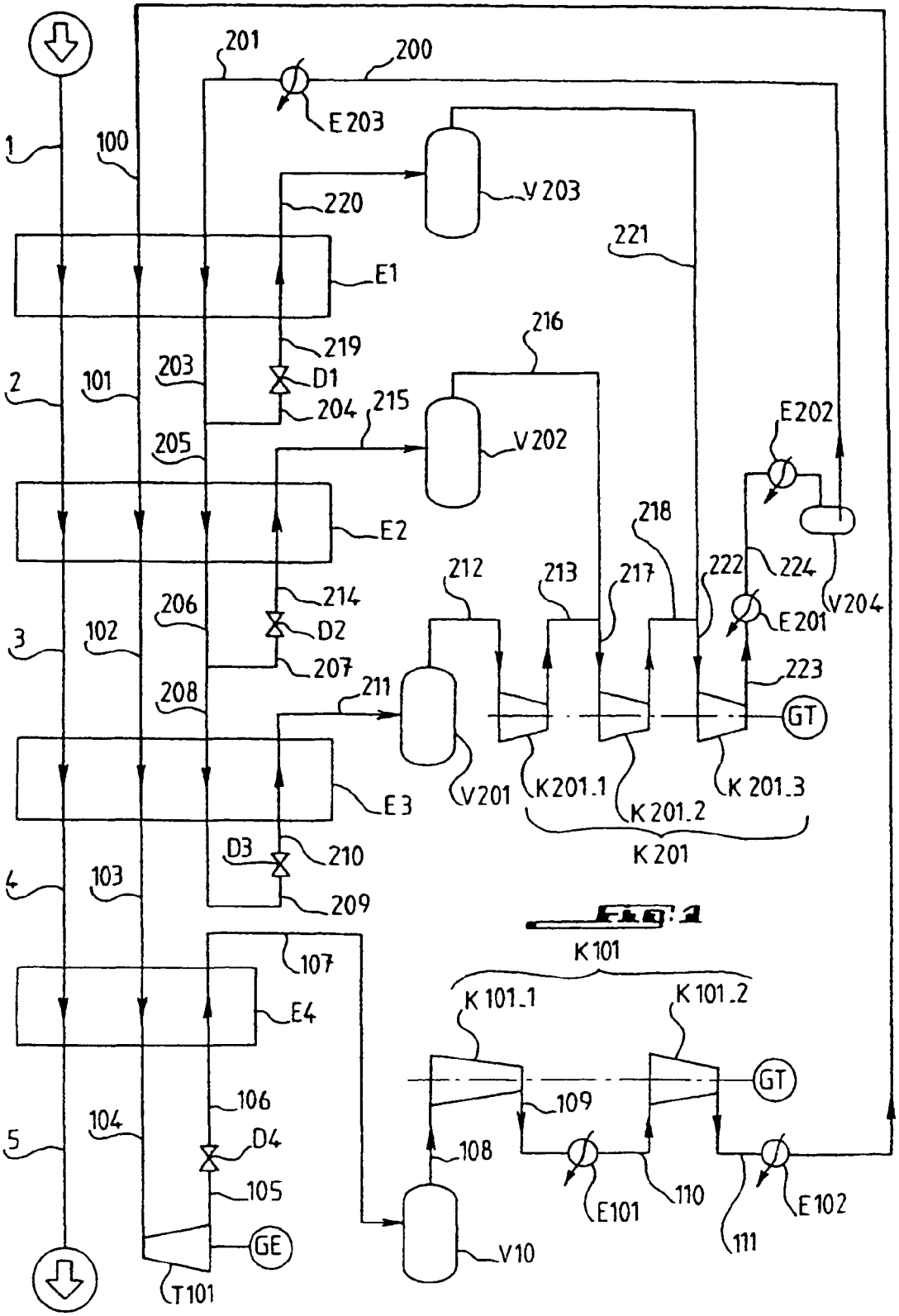
FIG. 1 shows a schematic functional diagram of a plant according to one possible embodiment of the invention.
Figure 2:
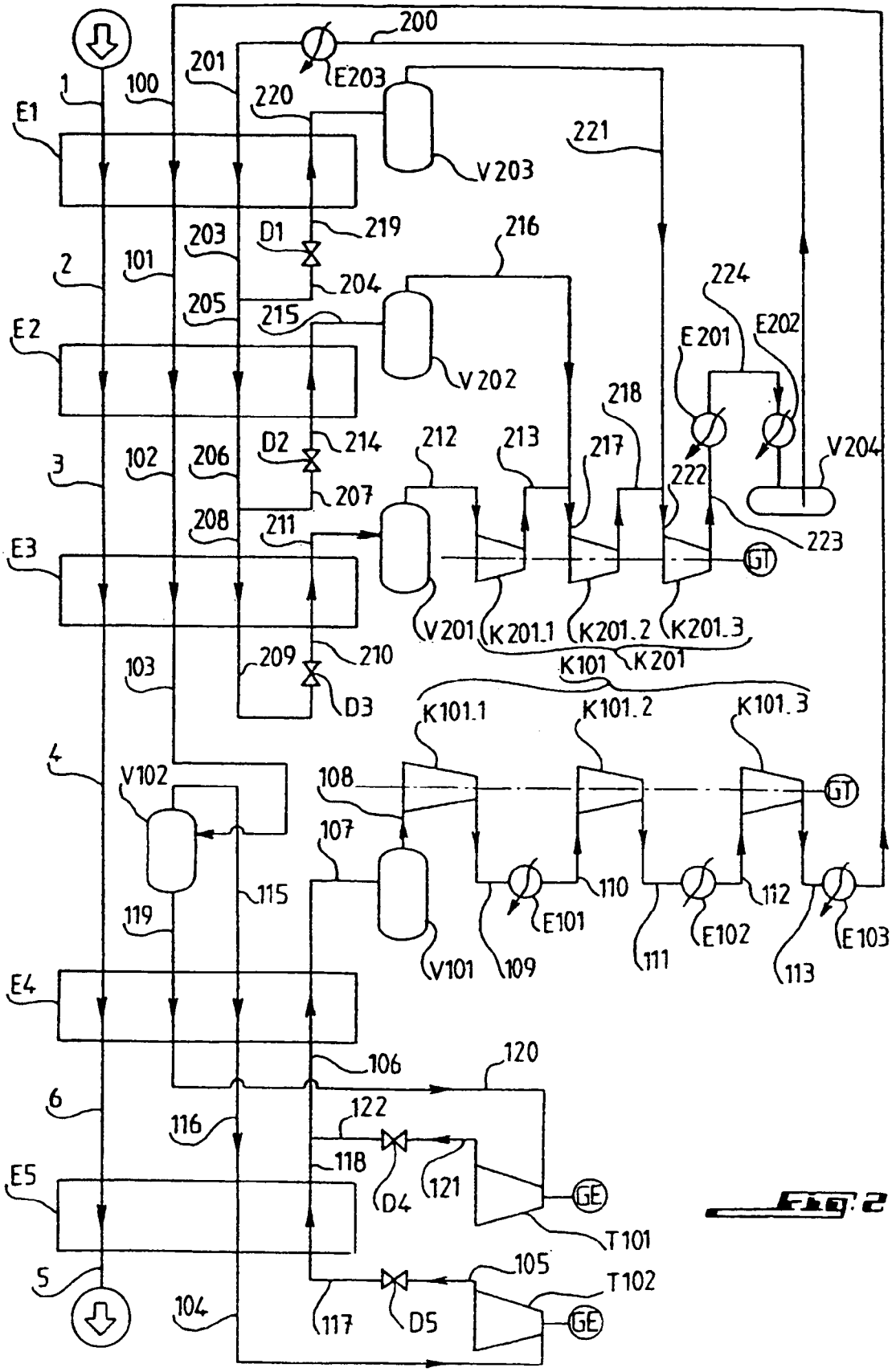
FIG. 2 shows a schematic functional diagram of a plant according to another possible embodiment of the invention.

For the sake of clarity and concision, the lines used in the plants of FIGS. 1 and 2 will be identified by the same reference numbers as the gaseous and/or liquid fractions that are flowing therein.

The plant shown in FIG. 1 is for liquefying a natural gas 1, under pressure, containing methane and $C_2$ and higher hydrocarbons. In a first step I, the natural gas 1 is subjected to a first refrigerating cycle in order to obtain a cooled natural gas 4 and is taken to a temperature below −20° C. by a first coolant 201 typically comprising ethane, propane and butane.

The first coolant 201 is, in a succession of substeps (i) to (v):

(i) subcooling by the first coolant 201 passing through a cryogenic exchanger E1, in order to obtain a stream 203. The stream 203 is divided into a stream 204 and a stream 205. The stream 205 is subcooled in a cryogenic exchanger E2, in order to obtain a stream 206. The stream 206 is divided into a stream 207 and a stream 208.

The stream 208 is subcooled in a cryogenic exchanger E3, in order to obtain a stream 209;

(ii) expansion: this is accomplished by each of the streams 204, 207 and 209 passing through a respective expansion valve V1 to V3, in order to obtain respective expanded streams 219, 214 and 210;

(iii) vaporization: the streams 219, 214 and 210 are each respectively vaporized in the cryogenic exchangers E1 to E3, in order to deliver respective vapor streams 220, 215 and 211. Each of these streams 220, 215 and 211 passes through a respective tank V203, V202 and V201, in order to deliver the respective streams 221, 216 and 212;

(iv) compression: the streams 221, 216 and 212 each feed a compressor K201 comprising a plurality of stages denoted by K201-1 to K201-3. The streams 212, 216 and 221 feed the compressor K201 onto the respective stages K201-1, K201-2 and K201-3, which have a progressively higher intake pressure. The compressor K201 delivers a stream 223 at its high-pressure stage K201-3; and (v) the stream 223 is at least partly condensed by cooling with a first external refrigerating fluid E201 in order to deliver a stream 224, this first external refrigerating fluid possibly being especially water or air. The stream 224 is completely condensed by a third external refrigerating fluid E202 and stored in a tank V204. The stream 200 is withdrawn from the tank V204 and cooled with a fourth external refrigerating fluid E203, in order to produce the first coolant 201.

In a second step II, the cooled natural gas 4 is subjected to a second refrigerating cycle in which the cooled natural gas 4 is cooled and condensed by a second coolant 103 comprising methane, ethane, propane, nitrogen and ethylene.

The second refrigerating cycle comprises a succession of substeps (i) to (vi) in which the second coolant 103 is:

(i) subcooled by passing through a cryogenic exchanger E4 in order to deliver a stream 104;

(ii) expanded by passing through an expansion turbine T101 coupled to an electric generator, denoted by EG. The turbine T101 produces a stream 105, which is then expanded in an expansion valve D4. The latter produces a stream 106;

(iii) the stream 106 is vaporized in the cryogenic exchanger E4, which delivers the stream 107. The latter passes into a tank V10, to give the stream 108;

(iv) the stream 108 feeds a compressor K101 at a low-pressure stage K101-1. The latter produces a medium-pressure stream 109 that is cooled by exchange with a stream E101, to give a cooled stream 110. The stream 110 is then introduced at a medium-pressure stage of the compressor K101, at the intake of the stage K101-2. The latter produces a stream 111;

(v) the stream 111 is cooled by exchange with a second external refrigerating fluid E102 in order to produce the stream 100; and, finally, (vi) the stream is at least partly condensed by cooling with said first coolant 201, during its successive passage through the exchangers E1 to E3.

Referring to FIG. 2, the plant shown is also intended for liquefying a natural gas 1, under pressure, containing methane and $C_2$ and higher hydrocarbons. In a first step I, the natural gas 1 is subjected to a first refrigerating cycle, in order to obtain a cooled natural gas 4, and is taken to a temperature below −20° C. by a first coolant 201 typically comprising ethane, propane and butane. This cycle is identical in its operation to that described in the case of FIG. 1. It is therefore unnecessary to describe it again.

The plant shown also includes a second refrigerating cycle having many similarities with that described in the case of FIG. 1. The differences are mentioned below:

The second coolant 103 is separated, in a tank V102, into a relatively more volatile first fraction 115 and a relatively less volatile second fraction 119.

The second fraction 119 is then treated in accordance with substeps (i) and (ii) of step II, as described above, in order to obtain a cooled and expanded second fraction 122.

Thus, this cooled and expanded second fraction 122 is obtained by cooling the second fraction 119 in a cryogenic exchanger E4 that delivers a fraction 120. The latter is expanded in a turbine T101, which produces an expanded stream 121. The latter stream 121 is expanded in a valve D4, which produces the cooled and expanded second fraction 122.

The cooled and expanded second fraction 122 is then mixed with a fraction 118 to give a stream 106. This stream 106 is vaporized in the exchanger E4, to produce the stream 107 that feeds, via a tank V101, a low-pressure stage K101-1 of a compressor K101.

The first fraction 115 is cooled in the exchanger E4, which delivers a stream 116. The latter is subcooled by passing through an exchanger E5 that produces a stream 104. The stream 104 is expanded by passing through a turbine T102, which produces an expanded stream 105.

Next, the stream 105 is expanded in a valve D5, which produces a stream 117. The latter is vaporized in the exchanger E5, which produces the stream 118. The stream 118 is then mixed with the cooled and expanded second fraction 122, in order to produce the stream 106.

Unlike FIG. 1, the compressor K101 comprises three compression stages, denoted by K101-1 to K101-3. Between each compression stage, the compressed gas is cooled by a respective fluid E101 to E103.

According to a modeling of the operation of the plants shown in FIGS. 1 and 2, the natural gas 1 feeds the plant with an input of 694936 kg/h. It is composed of 0.1% nitrogen, 93.8% methane, 4% ethane, 1% propane, 0.5% isobutane, 0.5% n-butane and 0.1% isopentane. Its temperature is 30° C.

The first coolant 201 is composed of 0.5% methane, 49.5% ethane, 49.5% propane and 0.5% isobutane.

The two tables below show the advantages of incorporating ethylene into the second coolant 103.

Table 1 relates to a plant operating according to FIG. 1 and Table 2 relates to a plant operating according to FIG. 2.

TABLE 1

Process with 2 coolants as a mixture, without phase separation

| Pressure of the natural gas | bar | 45 | 40 | 35 | 30 |
|---|---|---|---|---|---|
| Case without ethylene in the second coolant | | | | | |
| Composition of the coolant | | | | | |
| Nitrogen | mol % | 6.00 | 6.00 | 6.00 | 6.00 |
| Methane | mol % | 43.50 | 44.50 | 47.40 | 52.00 |
| Ethane | mol % | 49.50 | 48.50 | 45.60 | 41.00 |
| Ethylene | mol % | 0.00 | 0.00 | 0.00 | 0.00 |
| Propane | mol % | 1.00 | 1.00 | 1.00 | 1.00 |
| Total | | 100.00 | 100.00 | 100.00 | 100.00 |
| Pressure: stream 108 | bar | 2.85 | 2.85 | 2.85 | 2.85 |

TABLE 1-continued

| | | | | | |
|---|---|---|---|---|---|
| Pressure: stream 100 | bar | 47.98 | 48.49 | 50.05 | 52.50 |
| Power of the compressor K101 | kW | 83005 | 87179 | 93995 | 103893 |
| Power of the compressor K201 | kW | 87952 | 89063 | 91029 | 94027 |
| Total power | kW | 170957 | 176242 | 185024 | 197920 |
| Case with ethylene in the second coolant 103 | | | | | |
| Composition of the coolant | | | | | |
| Nitrogen | mol % | 6.00 | 6.00 | 6.00 | 6.00 |
| Methane | mol % | 43.50 | 43.50 | 43.50 | 43.50 |
| Ethane | mol % | 49.50 | 44.50 | 36.50 | 26.00 |
| Ethylene | mol % | 0.00 | 5.00 | 13.00 | 23.50 |
| Propane | mol % | 1.00 | 1.00 | 1.00 | 1.00 |
| Total | | 100.00 | 100.00 | 100.00 | 100.00 |
| Pressure: stream 108 | bar | 2.85 | 2.85 | 2.85 | 2.85 |
| Pressure: stream 100 | bar | 47.98 | 47.90 | 47.86 | 47.89 |
| Power of the compressor K101 | kW | 83005 | 86929 | 91453 | 96722 |
| Power of the compressor K201 | kW | 87952 | 89564 | 91901 | 94765 |
| Total power | kW | 170957 | 176493 | 183354 | 191487 |
| Saving achieved using ethylene | | | | | |
| Power saving with ethylene | kW | 0 | −251 | 1670 | 6433 |
| Relative power saving | % | 0.00 | −0.14 | 0.90 | 3.25 |
| Process with 2 coolants as a mixture, with phase separation | | | | | |
| Pressure of the natural gas | bar | 45 | 40 | 35 | 30 |
| Case without ethylene in the second coolant 103 | | | | | |
| Composition of the coolant | | | | | |
| Nitrogen | mol % | 3.00 | 3.00 | 3.00 | 3.00 |
| Methane | mol % | 43.00 | 46.20 | 49.70 | 53.90 |
| Ethane | mol % | 44.00 | 40.80 | 37.30 | 33.10 |
| Ethylene | mol % | 0.00 | 0.00 | 0.00 | 0.00 |
| Propane | mol % | 10.00 | 10.00 | 10.00 | 10.00 |
| Total | | 100.00 | 100.00 | 100.00 | 100.00 |
| Pressure: stream 108 | bar | 3.25 | 3.25 | 3.25 | 3.25 |
| Pressure: stream 100 | bar | 43.22 | 46.96 | 51.13 | 56.22 |
| Power of the compressor K101 | kW | 105557 | 114547 | 124746 | 137370 |
| Power of the compressor K201 | kW | 61749 | 61682 | 61530 | 61358 |
| Total power | kW | 167306 | 176229 | 186276 | 198728 |
| Case with ethylene in the second coolant 103 | | | | | |
| Composition of the coolant | | | | | |
| Nitrogen | mol % | 3.00 | 3.30 | 3.30 | 3.60 |
| Methane | mol % | 40.00 | 39.70 | 39.70 | 39.40 |
| Ethane | mol % | 39.00 | 32.00 | 24.00 | 12.80 |
| Ethylene | mol % | 8.00 | 15.00 | 23.00 | 34.20 |
| Propane | mol % | 10.00 | 10.00 | 10.00 | 10.00 |
| Total | | 100.00 | 100.00 | 100.00 | 100.00 |
| Pressure: stream 108 | bar | 3.25 | 3.25 | 3.25 | 3.25 |
| Pressure: stream 100 | bar | 41.03 | 42.41 | 43.60 | 45.61 |
| Power of the compressor K101 | kW | 102596 | 107863 | 113325 | 120974 |
| Power of the compressor K201 | kW | 62631 | 63188 | 63929 | 64624 |
| Total power | kW | 165227 | 171051 | 177254 | 185598 |
| Saving achieved using ethylene | | | | | |
| Power saving with ethylene | kW | 2079 | 5178 | 9022 | 13130 |
| Relative power saving | % | 1.24 | 2.94 | 4.84 | 6.61 |

As is apparent upon examining the results, the incorporation of ethylene into the second coolant accompanied by a reduction in the proportion of methane allows the power needed to liquefy the natural gas 1 to be significantly reduced. The saving is greater the lower the pressure of the natural gas 1. In addition, it may be seen that the pressure of the stream 108 is remarkably constant in the case of a plant according to FIG. 1. As regards the plant according to FIG. 2, the incorporation of ethylene makes it possible at least to limit the increase in pressure of the stream 100 relative to a system not using ethylene.

The invention is therefore remarkably advantageous by limiting the consumption of energy during the production of liquefied natural gas, in particular when the intake pressure of the natural gas to be liquefied is below 45 bar. This objective is achieved while still keeping the compression pressure of the second coolant output by the compressor K101 substantially constant.

The invention claimed is:

1. A process for liquefying a natural gas (1), under pressure, containing methane and C2 and higher hydrocarbons, said process comprising:

(a) a first step I, in which the natural gas (1) is subjected to a first refrigerating cycle in order to obtain a cooled natural gas (4) and is taken to a temperature below −20° C. by a first coolant (201), said first refrigerating cycle comprising a succession of substeps (i) to (v) in which the first coolant (201) is (i) subcooled, (ii) expanded, (iii) vaporized, (iv) compressed and (v) at least partly condensed by cooling with a first external refrigerating fluid (E201);

(b) a second step II, in which the cooled natural gas (4) coming from step I is subjected to a second refrigerating cycle in which the cooled natural gas (4) is cooled and condensed by a second coolant (103) comprising methane, ethane, propane and nitrogen, said second refrigerating cycle comprising a succession of substeps (i) to (vi) in which the second coolant (103) is (i) subcooled, (ii) expanded, (iii) vaporized, (iv) compressed, (v) cooled with a second external refrigerating fluid (E102) and (vi) at least partly condensed by cooling with said first coolant (201); the second coolant (103) furthermore containing ethylene, the total content in ethane and ethylene being close to 50 mol %, the second coolant (103) being subcooled without phase separation;

characterized in that the ethylene and ethane proportions in the second coolant are adjusted according to the intake pressure of the natural gas, and in that the ratio of the ethylene content in the second coolant (103), expressed in mol %, and the total content in ethylene and ethane in this same second coolant, expressed in mol %, to the total content in ethylene and ethane in this same second coolant, expressed in mol %, is greater than 25% when the natural gas is available at a pressure below 35 bar.

2. The process for liquefying a natural gas (1) as claimed in claim 1, characterized in that the ratio of the ethylene content in the second coolant (103), expressed in mol %, and the total content in ethylene and ethane in this same second coolant, expressed in mol %, to the total content in ethylene and ethane in this same second coolant, expressed in mol %, is equal to 26% when the natural gas is available at a pressure of 35 bar.

3. The process for liquefying a natural gas (1) as claimed in claim 1, characterized in that the ratio of the ethylene content in the second coolant (103), expressed in mol %, to the total content in ethylene and ethane in this same second coolant, expressed in mol %, is greater than 45% when the natural gas is available at a pressure below 30 bar.

4. The process for liquefying a natural gas (1) as claimed in claim 3, characterized in that the ratio of the ethylene content in the second coolant (103), expressed in mol %, to the total content in ethylene and ethane in this same second coolant, expressed in mol %, is equal to 48% when the natural gas is available at a pressure of 30 bar.

5. The process for liquefying a natural gas (1), under pressure, containing methane and C2 and higher hydrocarbons, said process comprising:

(a) a first step I, in which the natural gas (1) is subjected to a first refrigerating cycle in order to obtain a cooled natural gas (4) and is taken to a temperature below −20° C. by a first coolant (201), said first refrigerating cycle comprising a succession of substeps (i) to (v) in which the first coolant (201) is (i) subcooled, (ii) expanded, (iii) vaporized, (iv) compressed and (v) at least partly condensed by cooling with a first external refrigerating fluid (E201);

(b) a second step II, in which the cooled natural gas (4) coming from step I is subjected to a second refrigerating cycle in which the cooled natural gas (4) is cooled and condensed by a second coolant (103) comprising methane, ethane, propane and nitrogen, said second refrigerating cycle comprising a succession of substeps (i) to (vi) in which the second coolant (103) is (i) subcooled, (ii) expanded, (iii) vaporized, (iv) compressed, (v) cooled with a second external refrigerating fluid (E102) and (vi) at least partly condensed by cooling with said first coolant (201);

the second coolant (103) furthermore containing ethylene, the total content in ethane and ethylene being close to 50 mol %, characterized in that the second coolant (103) is separated into a relatively more volatile first fraction (115) and a relatively less volatile second fraction (119), said second fraction (119) then being treated in accordance with substeps (i) and (ii) of step II in order to obtain a cooled and expanded second fraction (122), then being treated in accordance with substep (iii) of step II, said first fraction (115) being cooled, subcooled, expanded, vaporized and then mixed with the cooled and expanded second fraction (122), in that the ethylene and ethane proportions in the second coolant are adjusted according to the intake pressure of the natural gas, and in that the ratio of the ethylene content in the second coolant (103), expressed in mol %, to the total content in ethylene and ethane in this same second coolant, expressed in mol %, is greater than 15% when the natural gas (1) is available at a pressure below 45 bar.

6. The process for liquefying a natural gas (1) as claimed in claim 5, characterized in that the ratio of the ethylene content in the second coolant (103), expressed in mol %, to the total content in ethylene and ethane in this same second coolant, expressed in mol %, is equal to 17% when the natural gas (1) is available at a pressure of 45 bar.

7. The process for liquefying a natural gas (1) as claimed in claim 5, characterized in that the ratio of the ethylene content in the second coolant (103), expressed in mol %, to the total content in ethylene and ethane in this same second coolant, expressed in mol %, is greater than 30% when the natural gas (1) is available at a pressure below 40 bar.

8. The process for liquefying a natural gas (1) as claimed in claim 7, characterized in that the ratio of the ethylene content in the second coolant (103), expressed in mol %, to the total content in ethylene and ethane in this same second coolant, expressed in mol %, is equal to 32% when the natural gas (1) is available at a pressure of 40 bar.

9. The process for liquefying a natural gas (1) as claimed in claim 7, characterized in that the ratio of the ethylene content in the second coolant (103), expressed in mol %, to the total content in ethylene and ethane in this same second coolant, expressed in mol %, is greater than 45% when the natural gas (1) is available at a pressure below 35 bar.

10. The process for liquefying a natural gas (1) as claimed in claim 9, characterized in that the ratio of the ethylene content in the second coolant (103), expressed in mol %, to the total content in ethylene and ethane in this same second coolant, expressed in mol %, is equal to 49% when the natural gas (1) is available at a pressure of 35 bar.

11. The process for liquefying a natural gas (1) as claimed in claim 9, characterized in that the ratio of the ethylene content in the second coolant (103), expressed in mol %, to the total content in ethylene and ethane in this same second coolant, expressed in mol %, is greater than 70% when the natural gas (1) is available at a pressure below 30 bar.

12. The process for liquefying a natural gas (1) as claimed in claim 11, characterized in that the ratio of the ethylene content in the second coolant (103), expressed in mol %, to the total content in ethylene and ethane in this same second coolant, expressed in mol %, is equal to 73% when the natural gas (1) is available at a pressure of 30 bar.

13. The process for liquefying a natural gas (1) as claimed in claim 1, characterized in that at least one of the first and second external refrigerating fluids (E201), E102) is a fluid available at ambient temperature.

14. The process for liquefying a natural gas (1) as claimed in claim 1, characterized in that at least a first expansion turbine (T101) is used for the treatment of the second coolant (103) at substep (ii) of step II.

15. The liquefaction process as claimed in claim 1, characterized in that the first coolant consists mainly of ethane and of propane.

16. The liquefaction process as claimed in claim 1, characterized in that the first coolant mainly consists of a hydrocarbon containing three carbon atoms, propane or propylene.

17. The liquefaction process as claimed in claim 1, characterized in that the cooled natural gas (4) coming from step I has the same composition as the feed natural gas (1).

* * * * *